United States Patent [19]

Kashiwagi et al.

[11] Patent Number: 4,519,694

[45] Date of Patent: May 28, 1985

[54] PROJECTION APPARATUS FOR AUTOMATIC CORRECTION OF NON-UNIFORM ILLUMINANCE DISTRIBUTION IN IMAGE AREA OF IMAGING PLANE

[75] Inventors: Kazuo Kashiwagi, Tokyo; Takao Toda, Shinagawa, both of Japan

[73] Assignee: Canon Kabushiki Kaisha, Tokyo, Japan

[21] Appl. No.: 507,581

[22] Filed: Jun. 24, 1983

[30] Foreign Application Priority Data

Jul. 2, 1982 [JP] Japan ..... 57-113984
May 23, 1983 [JP] Japan ..... 58-90200

[51] Int. Cl.[3] ..... G03G 15/00

[52] U.S. Cl. ..... 355/5; 355/14 E; 355/71

[58] Field of Search ..... 355/14 E, 68, 71; 354/5, 430, 432; 350/314, 311; 353/20, 55, 84, 85, 86, 87; 352/41, 42, 143, 198, 203; 362/285, 294, 289; 250/204, 205

[56] References Cited

U.S. PATENT DOCUMENTS

| | | | |
|---|---|---|---|
| 3,922,085 | 11/1975 | Sheets | 350/314 |
| 4,041,308 | 8/1977 | Fujita | 354/430 |
| 4,054,890 | 10/1977 | Shimomura | 354/227.1 |
| 4,153,364 | 5/1979 | Suzuki et al. | 355/68 |
| 4,256,372 | 3/1981 | Yasukuni et al. | 354/227.1 |
| 4,306,787 | 12/1981 | Fukuhara et al. | 354/432 |
| 4,333,720 | 6/1982 | Suzuki et al. | 354/227.1 |

*Primary Examiner*—R. L. Moses
*Assistant Examiner*—David S. Warren
*Attorney, Agent, or Firm*—Fitzpatrick, Cella, Harper & Scinto

[57] ABSTRACT

The present invention provides an apparatus for projecting the image of an original on the projection surface of a screen or photosensitive member, the apparatus having an illumination correction device for changing a distribution of illuminance on the projected surface, the illumination correction device being adapted to process a difference between the amount of a light passing near the center of the projection optical path and the amount of a light passing near the marginal portion of the same optical path to obtain the results on which the illumination correcting device will be controlled to correct any irregularity of the illuminance distribution on the projected surface.

38 Claims, 20 Drawing Figures

PROJECTION APPARATUS FOR AUTOMATIC CORRECTION OF NON-UNIFORM ILLUMINANCE DISTRIBUTION IN IMAGE AREA OF IMAGING PLANE

BACKGROUND OF THE INVENTION

1. Field of the Invention

The present invention relates to a projection apparatus for projecting an image of an original such as a microfilm, document, book or the like on a projection plane in a reader or copying machine.

2. Description of the Prior Art

In microfilm readers or reader-printers, an image recorded on a microfilm is projected on a screen through a projection lens in an increased magnification, this projected image being read as it is or further projected on a photosensitive member through the reader printer to obtain the copy thereof.

Since different rates of reduction are generally used when images are recorded on microfilms, the magnification of projection must be adjusted depending on the microfilms used.

The prior art variable magnification projection apparatus has such a disadvantage that when the magnification is changed to vary the rate of an optical path length across a lens, the distribution of light (illuminance) on the projected surface of a screen or photosensitive member will vary so that fluctuations are brought about with respect to the quality of image and the characteristics of the photosensitive member. In order to overcome this problem, a slit-exposure type copying machine has been proposed in which one of different slit plates is adapted to be inserted across the optical path on each change of magnification. Such a copying machines has, however, various disadvantages in that a mechanical structure, for example, the one for detecting the change of magnification, becomes more complicated and is increased in size, and in that the copying machine as a whole becomes more complicated since the shape of each slit plate must delicately be varied, and that the copying machine becomes expensive.

It has been also proposed that the distribution of light emission in an original illuminating lamp is changed depending on the change of magnification. However, this proposal does not provide the sufficient correction.

It has been also proposed that the distribution of illuminance on the projected surface be corrected by moving a condenser lens or lamp in connection with the change of magnification. Such a proposal also includes a disadvantage in that various mechanisms for detecting the changed magnification and for moving the lens or lamp in connection with the change of magnification will increasingly be complicated and increased in size as the number of selectable magnifications increases.

It has been further proposed that the magnification can be changed by selecting one of different lenses. In this case, it is required to utilize a so-called Köhler illumination for imaging the filament of an illumination lamp on the film-side pupil of a projection lens to effectively illuminate a group of exchangeable lenses. If the illumination is not proper, the light illuminating the projection lens may extremely be reduced in amount or unevenness may be brought about in the amount of light.

For such a reason, if the difference between one magnification and another magnification is smaller on projection, the distance of the film-side pupil from the surface of a film can be designed to be invariable for various different lenses to be used. If the difference in magnification is larger on projection, however, the pupil of the projection lens cannot be designed in the same manner. This also results in an increase in cost. A method is normally carried out in which the image of the filament in the illumination lamp is formed at the position of the film-side pupil in the projection lens by moving the condenser lens depending on the properties of the projection lens.

Such a method has, however, disadvantages in that a proper matching is hard to obtain since the position of the condenser lens is determined by eye-measurement, that an unskilled person may fail to match the position of the condenser lens to the property of the projection lens so that an obscure image will be observed with an effort, and that an unevenness may be produced in the density of copied images due to the unevenness of illumination to take wasteful copies in a printer.

SUMMARY OF THE INVENTION

It is an object of the present invention to overcome the above disadvantages in the prior art.

Another object of the present invention is to enable an image having less unevenness in brightness for observation and to obtain a copy having less irregularity in density.

A further object of the present invention is to provide an illumination suitable to a magnification to be used, even if the magnification is changed on projection.

A further object of the present invention is to provide a projection apparatus of a simple construction which can automatically equalize the distribution of illuminance even if the magnification on projection is more broadly changed.

The present invention will now be described with reference to embodiments which are illustrated in the drawings.

DESCRIPTION OF THE PREFERRED EMBODIMENTS

Figure 1:
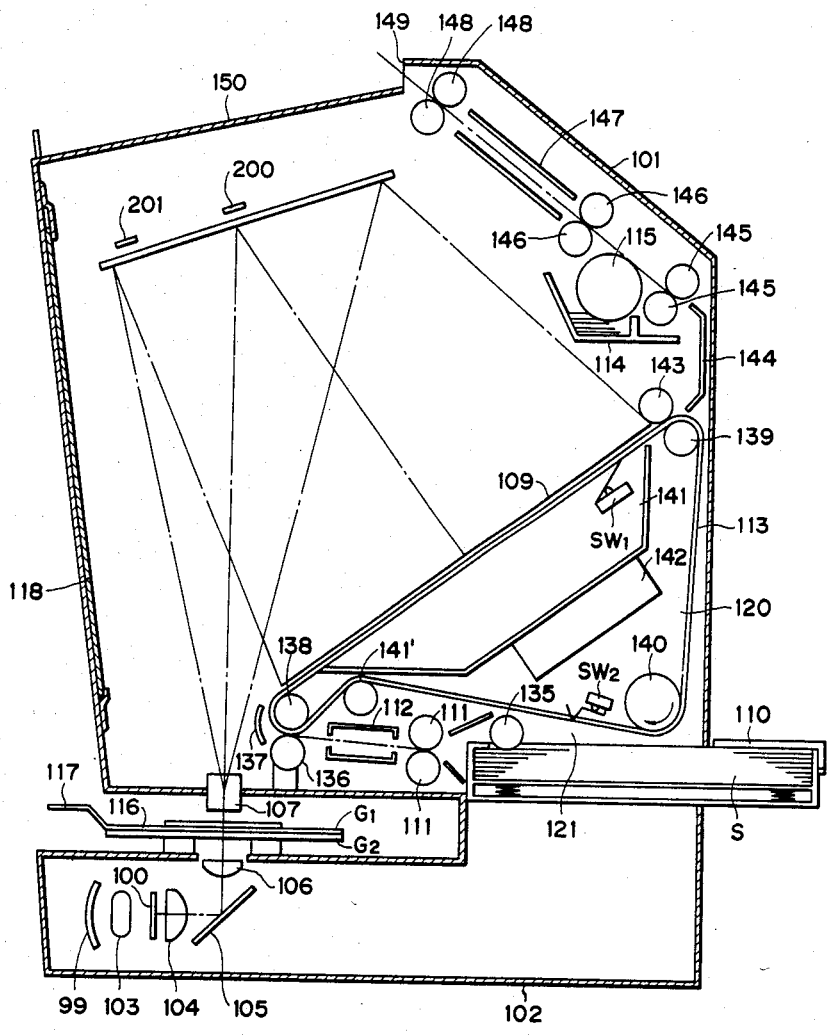
FIG. 1 is a schematic cross-section of a reader-printer which is an embodiment of the present invention.

FIG. 1 shows a reader-printer according to the present invention, which includes an upper casing 101 and a lower casing 102. Within the lower casing 102 are disposed a spherical reflection mirror 99, a lamp 103, a filter 100, a condenser lens 104, a reflector 105 and another condenser lens 106, all of which define an illuminating system. Within the upper casing 101 are disposed an optical system including a projection lens 107 and a half mirror 108; a reflection type screen receiving the light reflected by the mirror 108; a copy sheet supply cassette 110; a charger 112; copy sheet feeding means comprising feed rollers 111, a drive belt 113, a supply roller 135 and feed rollers 145, 146, 148; and development means including a tank of developing liquid 114, an development roller 115 and others. Between the second condenser lens 106 and the projection lens 107 is located a microfiche carrier 116 which holds two sheet glasses $G_1$ and $G_2$ with a microfiche film located therebetween. The carrier 116 is adapted to move on the lower casing 102. When the carrier 106 is moved in all the directions by operating an actuating handle 117, the microfiche film moves with the carrier as a unit to position the particular frame of the film in the optical path of projection.

The upper casing 101 includes an opening formed therein at the forward face for observing the interior of the casing 101. The opening is provided with a shutter 118 for closing the opening. If a projected image is to be copied, the shutter 118 blocks any external light into the upper casing through the observation opening. Atlernatively, the shutter may be replaced by a member functioning to control a light from a projected image so that the light can be transmitted therethrough when the image is observed. Such a member includes a filter or closing plate of a material which can vary in spectral transmission factor when a voltage is applied thereto, such as a liquid crystal or an electrochromic substance.

The filter may suitably be colored to optimize the contrast in an image projected on a screen when the image is ovserved through the filter. The filter may be, for example, of "Varad" (trade mark possessed by Marks Polarized Corp.). The "Varad" filter is in the form of a plate which includes a dipole suspended between a pair of transparent electrodes. When a voltage is applied between the pair of electrodes, the dipole is rearranged perpendicular to the electrodes to permit the plate to transmit the light. If the electrodes are deenergized, the dipole is brought into a scattering state to block any light through the plate.

When the machine is in its read mode, the shutter 118 is in its light transmitting state and the screen 109 is placed at a projection plane on which an image in the film is imaged. As a result, the image projected on the screen can be read through the observation opening.

The reflection type screen 109 is used to read an optical image incident on the forward face thereof from the same side of the screen. The screen 109 is in the form of a sheet of paper having a light-diffusive surface or a white-colored cloth having a roughed surface which is mounted at one side on the drive belt 113 for carrying copy sheets to move therewith or in the form of a drive belt to which a light-diffusive material is applied at one side. The drive belt 113 includes a positioning aperture 121 formed therein. When this aperture 121 is detected by a microswitch $SW_2$, the drive belt is stopped to position the screen 109 at a position shown by solid line in FIG. 1. At this time, the screen 109 will be placed in a projected plane. Another microswitch $SW_1$ is located near the marginal portion of the exposed plane and serves to detect a copy sheet fed thereto.

Copy sheets S are contained in a supply cassette 110 one above another. The copy sheet may be of a so-called electrofax paper which is coated with zinc oxide. If a copy instruction is inputted by operating a copy button, the known supply roller 135 begins to rotate to feed one of the copy sheets S out of the cassette 110 into the nip between the feed rollers 111 and to move that copy sheet to the charger 112 by means of the rotating feed rollers 111. The fed copy sheet is uniformly charged by the charger 112 to have a photosensitive property. Subsequently, the charged copy sheet is fed onto the surface of the drive belt 113 through a guide plate 137 by incorporation of the drive belt 113 with a guide roller 136. The drive belt 113 is endless and passed over the rollers 138, 139 and a drive roller 140 to form a triangle shape. The drive roller 140 is connected to a drive to move the belt 113 when the drive is energized. The belt 113 is adjusted by a roller 141' with respect to tension. The surface of the drive belt 113 includes a plurality of slots formed therethrough in several rows. A suction device is disposed within the triangle defined by the belt 113 and positioned at a position opposing to the oblique side of the triangle. The suction device 141 includes a plurality of suction openings formed therein at the side of the suction device opposing to the belt 113 and is connected with a blower 142.

When the blower 142 is energized, a copy sheet S supplied onto the run of the belt 113 corresponding to the oblique side of the triangle by incorporation of the belt 113 with the guide roller 136 is drawn toward the surface of the drive belt 113 under the action of the suction device 141 and then moved to the projected plane as the drive belt is moved.

The projected plane is substantially at a position corresponding to the oblique face of the drive belt 113. Although the screen is about one millimeter thick and a copy sheet S is about 0.1 millimeters thick, the screen and copy sheet are positioned within the focal depth of a lens if an image is focused in the projected plane through the optical system, so that the lens is not required to be adjusted at each change of mode.

If the leading edge of the copy sheet S is brought into contact with the microswitch $SW_1$, the drive belt 113 is deenergized. On the other hand, the shutter 118 is changed to its light blocking state in accordance with a copy instruction. Thus, the machine will be changed from its read mode to its copy mode.

When the copy sheet S is placed on the projected plane, an image in the film is projected thereon. On termination of the exposure, the belt 113 is again energized to move the copy sheet S on which a latent image is formed by the exposure, upwardly along the oblique run of the drive belt toward the nip between the belt and a pinch roller 143. After leaving the nip between the drive belt and the pinch roller, the copy sheet S is moved along a guide plate 144 to the nip between the feed rollers 145. On the other hand, the drive belt 113 continues to move. When the positioning aperture 121 in the belt 113 is detected by the microswitch $SW_2$, the drive belt is stopped. Thus, the screen is re-positioned in the projected plane. At the same time, the shutter 118 is changed to its light transmitting state. By the feed rollers 145, the copy sheet S is moved to the development roller 115 whereat it is developed, and then to the gap between guide plates 147. Thereafter, the copy sheet S is exhausted from the exit 149 of the upper casing 101 to a tray 150 supported by the lower casing 102 by means of exhausting rollers 148. Further details are omitted since the above process for forming the image is known in the art.

Light from the illumination lamp 103 passes through the filter 100 and the first condenser lens 104 and then turned to the second condenser lens 104 through 90° by the reflection mirror 105. After passing through the second condenser lens 106, the light is focused on the film-side pupil of the projector lens 107 located above the condenser lens 106 to form an image of the filament in the illumination lamp 103. The projection lens 107 can be replaced by one of various lenses having different focal lengths to change the magnification on projection. These interchangeable lenses are so designed that the film-side pupils thereof are substantially in the same position to always provide a substantially invariable brightness (illuminance) in the projected plane even if one of the lenses is replaced by the other.

Behind the half mirror 108, there are located a first photoelectronic converter (i.e., photoelectric converter) element 200 at a position substantially corresponding to the optical axis of the projection lens 107 and a second photoelectronic converter element 201 at a position substantially corresponding to one of the marginal portions of the projection lens 107.

Figure 2:
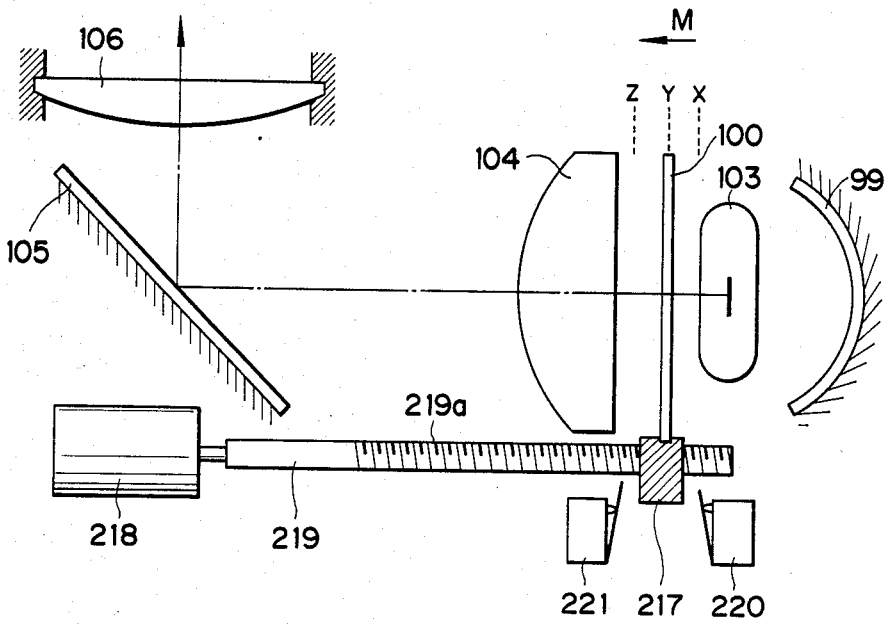
FIG. 2 is a schematic view of the illuminating section in the reader-printer shown in FIG. 1.

FIG. 2 shows the details of the illumination section in which the filter 100 is fixed to a support block 217. The block 217 includes a threaded aperture formed therethrough, into which the threaded section 219*a* of a screw rod 219 directly connected with a reversible motor 218 is screwed. When the motor 218 is energized to rotate the screw rod 219, the rotation thereof causes the block 217 to move along the screw rod 219. Thus, the filter 100 is reciprocated along the optical axis of the optical path of illumination between the lamp 103 and the first condenser lens 104. Limit switches 220 and 221 are located at the opposite ends of movement in the block 217 to limit the movement thereof in the opposite directions.

Figure 3:
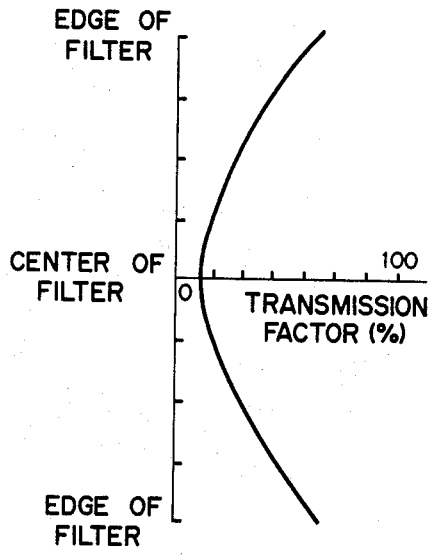
FIG. 3 is a graph showing the characteristics of light transmission in a filter 100.

The filter 100 is in the form of a circular density filter which has the least spectral transmission factor at the center thereof, this spectral transmission factor being gradually increased from the center to the periphery of the filter. FIG. 3 shows such a change of the filter in spectral transmission factor.

Figure 4:
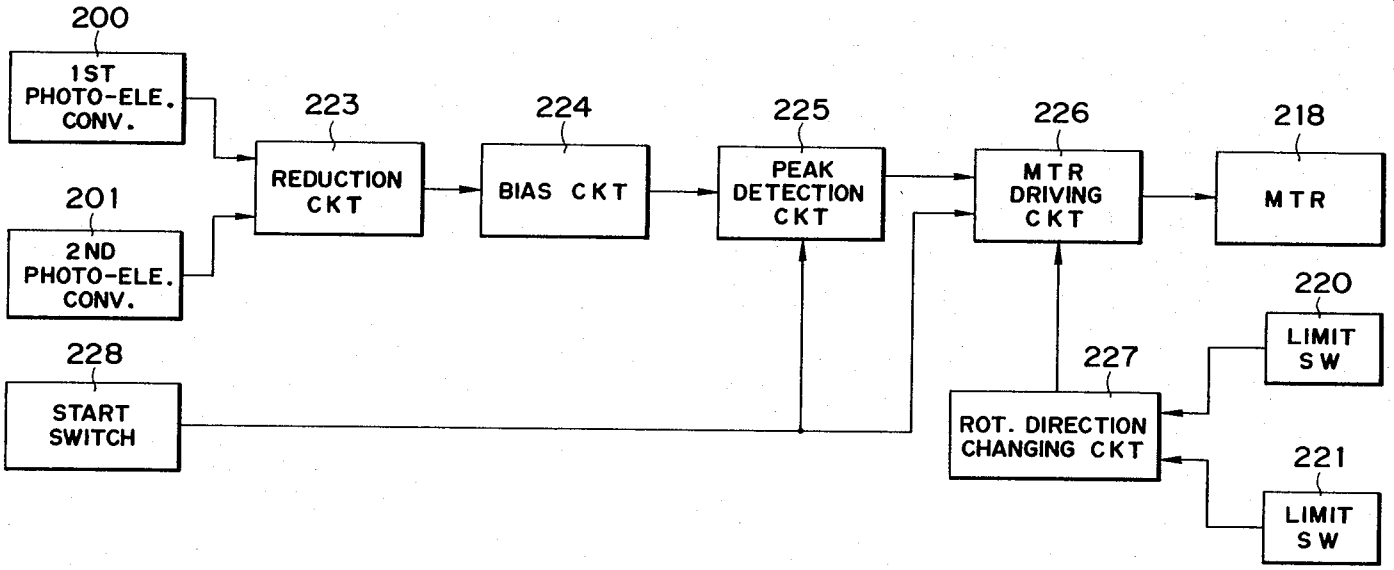
FIG. 4 is a block diagram of a control circuit for correcting the distribution of illuminance.

FIG. 4 shows a block diagram of a control circuit for correcting a distribution of illumination in the projected plane. In FIG. 4, the control circuit comprises photoelectronic converter elements as shown by 200, 201 in FIG. 1; a reduction circuit 223 for processing a difference between the output voltages from the first and second photoelectronic converter elements 200, 201; a bias circuit 224 for applying a bias voltage to the output of the reduction circuit 223 so that the results in the reduction circuit 223 will be maintained positive; a peak detection circuit 225 for sensing the peak in the output signal from the bias circuit 224; a motor drive circuit 226 for controlling the rotation of the motor 218 shown in FIG. 2; a rotational direction changing circuit 227 for generating at its output a signal used to change the rotational direction of the motor 218 when receiving the outputs from the limit switches 220 and 221 shown in FIG. 2; and a start instruction switch 228 for actuating the peak detection circuit 225 and for generating at its output a start signal used to energize the motor 218.

Figure 5A:
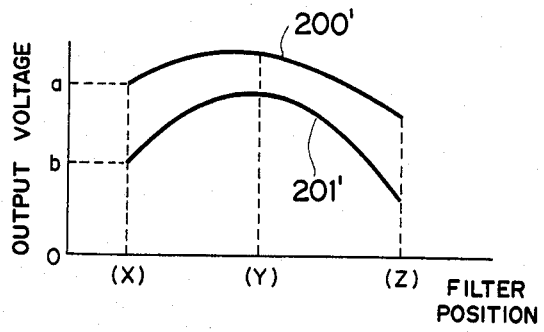
FIGS. 5A–5D are views illustrating the output signals in various sections of the control circuit shown in FIG. 4.
Figure 5B:
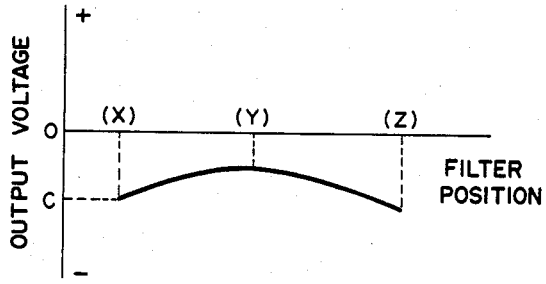
Figure 5C:
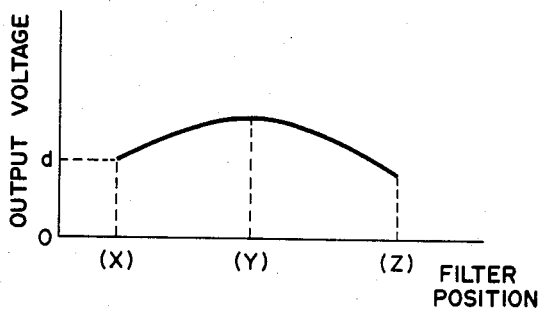
Figure 5D:
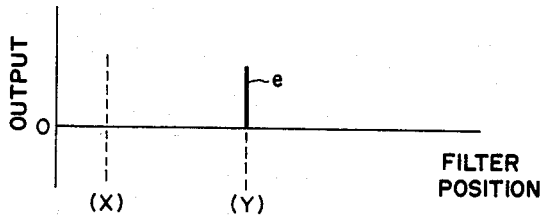

FIGS. 5A through 5D illustrate the output signals from the various sections in the above control circuitry when no film is inserted into the carrier 116, the lamp 103 is turned on and the filter 100 has been moved to a position Z from a position X shown in FIG. 2. In these figures, the horizontal axis represents the position of the filter while the vertical axis represents the output voltage of the block. In FIG. 5A, a curve 200′ represents the output voltage from the first photoelectronic converter element 200 while a curve 201′ represents a change in the output voltage from the second photoelectronic converter element 201. Each of the photoelectronic converter elements 200 and 201 provides an increased output voltage when receiving more light. FIG. 5B shows the output of the reduction circuit 223, FIG. 5C illustrates the output of the bias circuit 224, and FIG. 5D represents the output of the peak detection circuit 225.

The machine will be operated as follows: Assuming that the lamp 103 is turned on by an operator through a power switch (not shown) with no film inserted into the fiche-carrier 116 and that the filter 100 is in the position (X) shown in FIG. 2. The first and second photoelectronic converter elements 200 and 201 generate output voltages (a) and (b) on the point (X) in FIG. 5A, respectively. The reduction circuit 223 processes the difference between the output voltages (b) of the second photoelectronic converter element 201 and the output voltage (a) of the first photoelectronic converter element 200. The resulting value (b−a) becomes a voltage c as shown in FIG. 5B. The bias circuit 224 applies a constant bias voltage to the output of the reduction circuit 223 to convert the negative output voltage c from the reduction circuit 223 into a positive voltage d as shown in FIG. 5C. This output of the bias circuit 224 is supplied to the peak detection circuit 225.

Next, if the start switch 228 is depressed by the operator, a start signal is generated to energize the motor 218 through the motor drive circuit 226. At the same time, the peak detection circuit 225 begins to operate. Thus, the filter 100 begins to move in the direction of arrow M (FIG. 2). The movement of the filter changes the outputs of the first and second photoelectronic converter elements 200 and 201, the reduction circuit 223, the bias circuit 224 and the peak detection circuit 225 as shown in FIGS. 5A to 5D. These changed outputs correspond to the position of the filter. When the difference between the outputs of the two photoelectronic converter elements 200, 201 reaches its minimum value, the distribution of illuminance on the projected plane (or the film surface) has the least unevenness. This means that the filter is properly positioned. In other words, when the filter 100 reaches the point (Y), a peak (it is produced when the difference between the outputs of the photoelectronic converter elements 200, 201 has the least value) is detected by the peak detection circuit 225 which in turn generates a peak detection signal e. This peak detection signal is used to deenergize the motor 218 through the motor drive circuit 226. In this manner, the distribution of illuminance will most be equalized on the projected plane. This means that the illumination system is properly set. Therefore, the operator can insert a film into the fiche-carrier 116 to observe the film under optimum conditions.

Although the description has been made as a peak value is detected immediately after the motor has been energized, the block 217 may be engaged by the limit switch 220 or 221 if the filter is moved from an inproper start position in an inproper direction. In such a case, a reversal signal is supplied to the rotational direction changing circuit 227 which in turn generates a signal for changing the rotational direction in the motor. This signal is applied to the motor drive circuit 226 to reverse the rotation of the motor 218. Thereafter, the above peak detection is continued. When a peak is detected, the motor 218 is deenergized.

Although the illustrated embodiment has been described as to initiate the rotation of the motor in one direction and then reverse the rotation by the limit switch if no peak is detected in the one direction, the output of the reduction circuit 223 may be used to compare the present value with the preceding value to determine the rotational direction of the motor so that the peak value can be detected always through the minimum distance.

For example, the first output of the reduction circuit before the motor is energized is compared with the second output of the same immediately after the motor is rotated only a little. If the second output is larger than the first output, the motor continues to rotate in the same direction. If the second output is smaller than the first output, the rotation of the motor is reversed.

In the illustrated embodiment, the filter is disposed between the lamp and the first condenser lens. However, the filter may be located between the second condenser lens and the supporting surface on which the film is placed.

Figure 6:
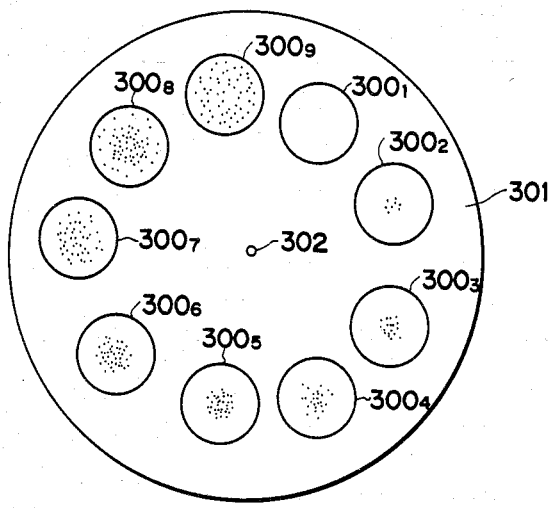
FIG. 6 is a front elevational view showing another embodiment of the filter according to the present invention.

FIG. 6 shows the other embodiment of the filter in which a plurality of filtrating elements $300_1$–$300_9$ are located on a disc 301 in a circle. The disc 301 is connected with a motor and rotated by the same about a shaft 302 to bring the selected one of the filtrating elements into alignment with the illumination path between the lamp 103 and the first condenser lens 104. The filtrating elements $300_1$–$300_9$ are different from one another in the distribution of intensity for transmitted light. In FIG. 6, areas denoted by a number of dots are lower in spectral transmission factor. In each of such areas, the spectral transmission factor increase gradually from the center to the periphery. The motor for driving the disc 301 is controlled based on the difference between the outputs of two photoelectronic converter elements 200 and 201 to select a filtrating element for providing a desired distribution of illuminance on the projected plane.

Figure 7:
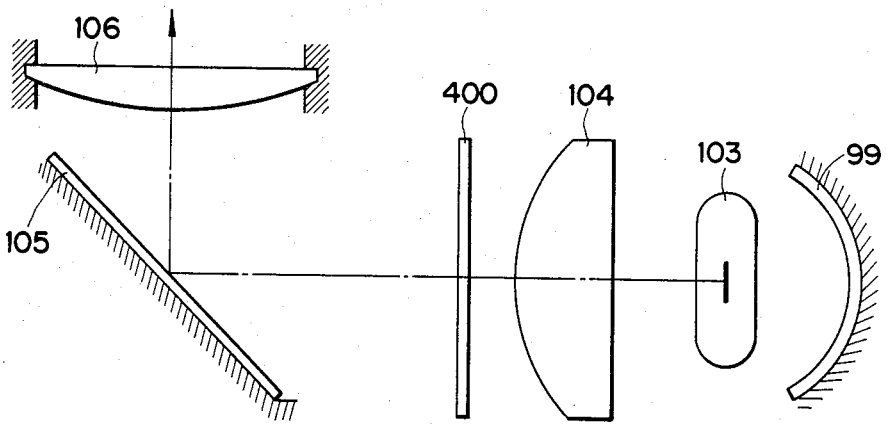
FIG. 7 is a schematic diagram of the other embodiment of the illuminating section according to the present invention.
Figure 8:
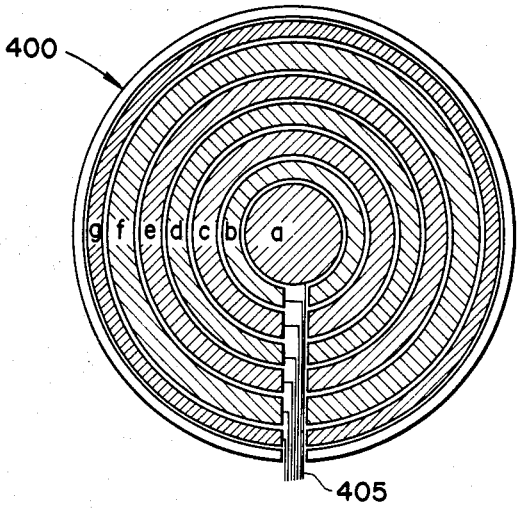
FIG. 8 is a front elevational view of a filter 400.
Figure 9:
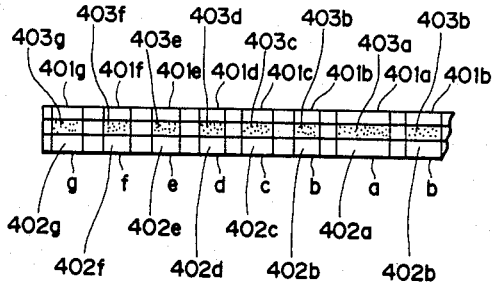
FIG. 9 is a cross-sectional view of the filter 400.

FIG. 7 shows a further embodiment of the illumination section for correcting the distribution of illuminance in which similar parts are designated by similar numerals. The illumination section of FIG. 7 is different from that of FIG. 2 in that a filter 400 shown in FIG. 7 is disposed between the first condenser lens 104 and the second condenser lens 106 and that the structure of the filter itself is different from that of the filter shown in FIG. 2. Moreover, the filter 400 is stationary. FIG. 8 is a front elevational view of the filter 400 and FIG. 9 is a cross-section of the same. The filter 400 includes a plurality of annular discoloring plates a–g which are disposed concentrically relative to one another and spaced apart from one another so that one plate can become transparent or opaque independently of the others. The filter 400 is located in the illumination path through which a collimated beam of light passes. As seen from FIG. 9, each of the discoloring plates includes a liquid crystal element (403*a*, 403*b* . . . 403*g*) located between a first transparent electrode (401*a*, 401*b* . . . 401*g*) and a second transparent electrode (402*a*, 402*b* . . . 402*g*). Preferably, the filter 400 may be located at a position spaced away from the lamp 103 rather than the second condenser lens 106. Further, a heat insulating filter may preferably be disposed in front of the filter 400. If a voltage is applied between the opposed electrodes (for example, 401*a* and 402*a*), a liquid crystal (403*a*) therebetween discolors to make the corresponding discoloring plate (a) opaque. If no voltage is applied, the discoloring plate is transparent. When the discoloring plate becomes opaque, the transmission of light therethrough is reduced. If the discoloring plates are selectively changed in color from the center to the periphery of the filter 400, the whole filter 400 is changed with respect to its distribution of intensity for transmitted light.

Figure 10:
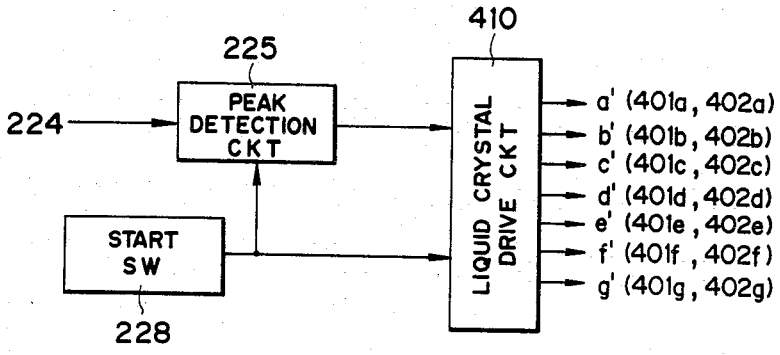
FIG. 10 is a block diagram of the other embodiment of the control circuit according to the present invention.

FIG. 10 shows a control circuit for changing the filter 400 with respect to the distribution of intensity for transmitting light. In FIG. 10, the same parts as in FIG. 4 are omitted. The control circuit includes a liquid crystal drive circuit 410 connected to the peak detection circuit 225 and start instruction switch 228 as shown in FIG. 4. The liquid crystal drive circuit 410 is connected to a group of electric terminals 405 leading to the pairs of electrodes (hereinafter called a′, b′, c′, e′, f′ and g′) in the discoloring plates a–g. Voltage is applied to these electrodes a′–g′ in the order as described. Once a voltage is applied to a pair of electrodes, these electrodes continue to be energized even after a voltage has been applied to another pair of electrodes. After all the electrodes a′–g′ have been energized, they are deenergized. Subsequently, voltage is again applied to the electrodes in the order from a′ to g′. Such application of voltage will be repeated. If a peak signal is outputted from the peak detection circuit 225, the application of voltage is stopped at the last energized electrodes.

In the above-mentioned embodiment, if the image in a film is projected on the projected plane in which a screen or photosensitive sheet is placed, for example, through a projection lens having a short focal length, only a narrow area in the film (hereinafter called effective projection area) is projected on the projected plane in high magnification since the distance between the film and the projected plane is constant. Since at this time, the difference between the outputs of the first and second photoelectronic converter elements 200 and 201 is smaller, voltage is applied to one or more discoloring plates near the center of filter 400 to make them opaque near the center of the effective projection area so that the amount of light passing near the center of the optical illumination path will be decreased to equalize the distribution of illuminance on the projected plane without any change of areas other than the center of the optical illumination path with respect to the amount of light. On the contrary, if the image in the film is projected on the projected plane by the use of a projection lens having a longer focal length, the effective projection area in the film is increased so that the difference between the outputs of the first and second photoelectronic converter elements 200 and 201 will be increased. Voltage is therefore applied to discoloring plates more than those in the above-mentioned case at and near the center of the filter 400 so that they will be opaque at the center and surrounding region of the effective projection area. The amount of light will be reduced at the center and surrounding region of the optical illumination path to equalize the distribution of illumination on the projected plane. The other region of the optical illumination path remains constant with respect to the amount of light.

In addition to the liquid crystal, the material of the discoloring plates includes any other material which can vary with its spectral transmission factor when a voltage is applied thereto, such as electrochromic substance, photochromic substance, Varad or the like. The spectral transmission factor in each discoloring plate, for example, of liquid crystal may be changed by changing the voltage to be applied to the pair of transparent electrodes in the corresponding discoloring plate. Furthermore, the filter 100 of FIG. 2 may be combined with the filter 400 of FIG. 7 to correct any unevenness in the distribution of illuminance on the projected plane.

The positions of the first and second photoelectronic converter elements for measuring the amount of light are not limited to the illustrated arrangements. Although the photometry and control have been initiated by operating the start instruction switch in the aforementioned embodiments, they may be initiated by generating a start instruction signal at the same time as a power switch is turned on or as a projection lens is replaced by another projection lens to change the magnification.

Figure 11:
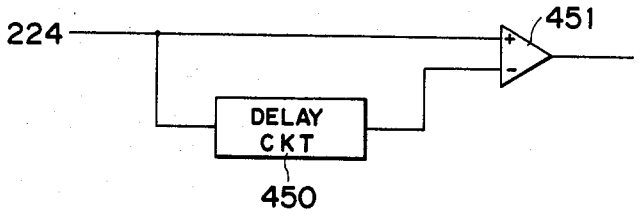
FIG. 11 is a view showing an example of a peak detection circuit.

FIG. 11 shows an example of the peak detection circuit which comprises a delay circuit 450 for delaying the output of the bias circuit 224 and a comparator 451 for comparing the output of the bias circuit 224 with that of the delay circuit 450. The comparator 451 is adapted to generate a peak signal at its output if the relationship between two input signals is reversed in magnitude. The peak detection circuit can be replaced by one of the conventional peak detection circuits.

Although the magnification has been changed by replacing a projection lens with another projection lens in the afore-mentioned embodiments, it may be changed by using a fixed focus lens to change its optical path or by using a zoom lens.

If the position of the film-side pupil in a projection lens is extremely fluctuated on changing the magnification, the condenser lenses or the illumination lamp may be re-positioned.

Figure 12:
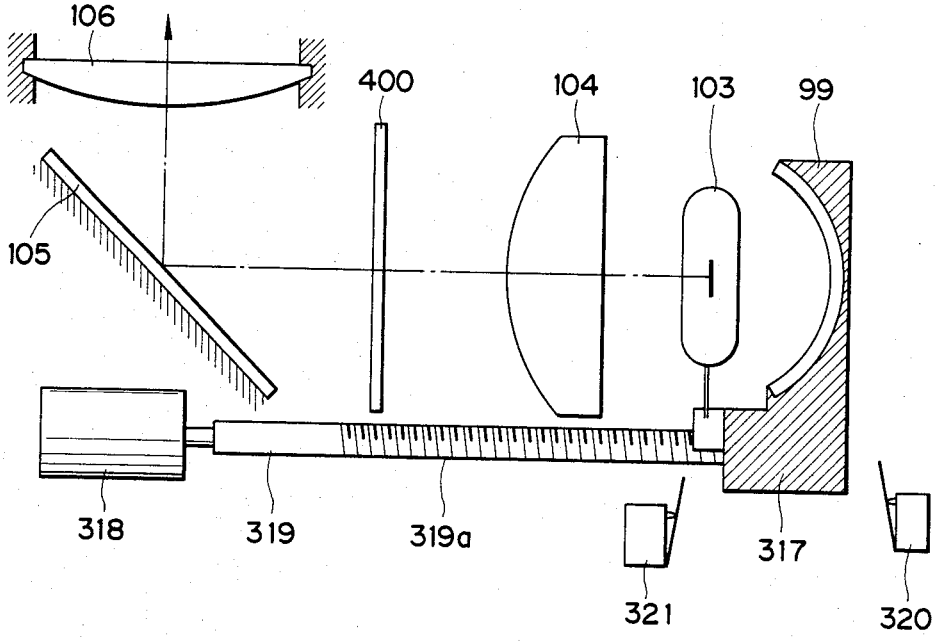
FIG. 12 is a schematic diagram showing the other embodiment of the illustrating section according to the present invention.

FIG. 12 shows a further embodiment of the illuminating section according to the present invention in which in combination with the filter of FIG. 7, an illuminating lamp may be moved to correct the distribution of illuminance.

Figure 13:
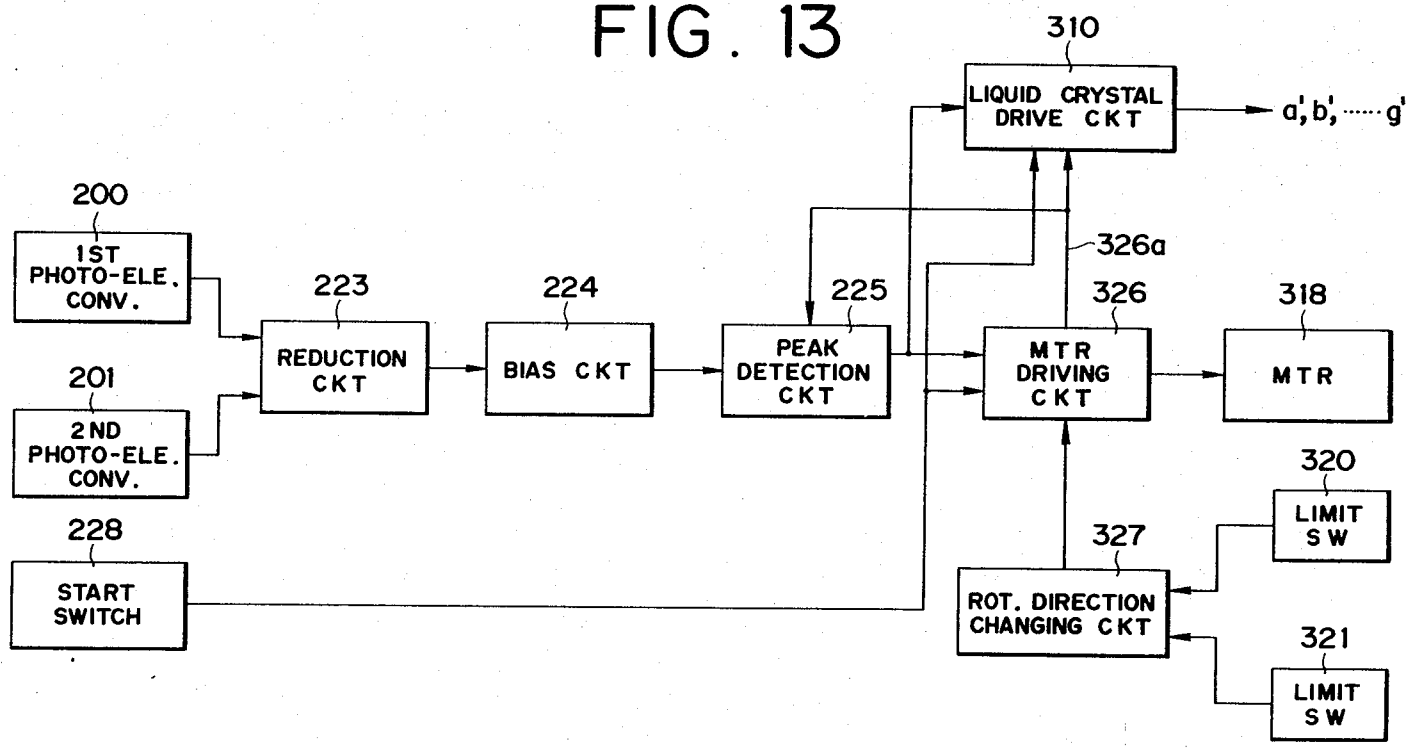
FIG. 13 is a block diagram showing a control circuit used in the illuminating section shown in FIG. 12.

FIG. 13 shows a control circuit used in the illumination section shown in FIG. 12. In FIGS. 12 and 13, parts similar to those in the afore-mentioned embodiments are designated by similar numerals.

In FIG. 12, a lamp 103 and spherical reflection mirror 99 are supported by a block 317 which includes a threaded opening formed therethrough. A screw rod 319 has a threaded portion 319*a* which threadedly screwed into the threaded opening of the block 317. The screw rod 319 is connected to a reversible motor 318 and rotated by the same. As the rod 319 is rotated by the motor 318, the block 317 moves along the screw rod 319. The lamp 103 and mirror 99 move together with the block as a unit to change the position in which the filament in the lamp 103 is to be imaged. The range in which the block 317 moves is defined by limit switches 320 and 321 as in FIG. 2. The control circuit comprises a motor drive circuit 326 as in FIG. 4. Upon receiving an output of the peak detection circuit 225, the motor drive circuit 326 controls the motor 318. The control circuit also comprises a rotational direction changing circuit 327 for generating at its output a signal used to change the rotational direction of the motor 318 when receiving the outputs of the limit switches 320 and 321 and a liquid crystal drive circuit 310 for applying voltage to electrodes a', b', . . . g' of the discoloring plates in the filter 400 shown in FIG. 11. When a start signal from the start instruction switch 228 is received, the liquid crystal drive circuit 310 is adapted not to energize all the electrodes a', b' . . . g'. If the liquid crystal drive circuit 310 receives a motor stop signal (described hereinafter) from the motor drive circuit 326, it successively energizes the electrodes in the order from a' to g'. After the motor stop signal has been generated and when the peak detection circuit 225 generates a peak signal, the application of voltage is stopped at the lastly energized electrodes.

In FIGS. 12 and 13, the peak detection circuit 225 and the motor drive circuit 326 are actuated by operating the start instruction switch 228 to energize the motor 318. On the other hand, the liquid crystal drive circuit 310 does not energize all the electrodes a', b' . . . g' even when the start instruction switch 228 is turned on. As a result, the whole filter 400 remains transparent. If the lamp 103 is moved by the motor 318 and when the difference between the outputs of the first and second photoelectronic converter elements 200 and 201 reaches its minimum value, the peak detection circuit 225 generates a peak signal which is in turn used to stop the motor 318. Thus, the lamp 103 is positioned at a location in which the filament of the lamp 103 is imaged near the film-side pupil of the projection lens. As a result, the illuminance on the projected plane is corrected irrespective of any change in magnification. As the motor 103 is stopped, the motor drive circuit 326 generates a motor stop signal at the output terminal 326*a* thereof. This motor stop signal is used to reset the peak detection circuit 225 and then re-start the same. With this motor stop signal, the liquid crystal drive circuit 310 is actuated so that voltage is successively applied to the electrodes a' to g' as in FIG. 10. If voltage is applied to the selected electrodes, the peak detection circuit 225 generates a peak signal at the output thereof so that the application of voltage will be stopped at this point of time.

On changing the magnification, thus, the distribution of illuminance can exactly be corrected only through two correction operations, that is, the first operation based on the movement of the lamp 103 and the second operation based on the control of the filter 400 with respect to the spectral transmission factor thereof.

The movement of the lamp may be replaced by the movement of the condenser lenses along the optical illumination path or the selection of plural condensers having different focal lengths which are disposed in the optical illumination path. Further, the filter 400 may be replaced by one of the filters shown in FIGS. 2 and 6.

Figure 14:
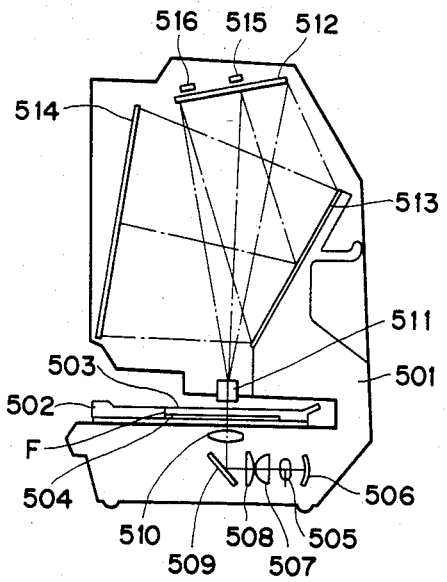
FIG. 14 is a schematic diagram of a further embodiment of the reader-printer according to the present invention.

FIG. 14 shows another embodiment of the reader-printer according to the present invention and which comprises a reader casing 501. The casing 501 includes a fiche-carrier 502 mounted thereon which holds two confining glass plates 503 and 504 with a microfilm F being placed therebetween. Thus, each frame in the microfilm can selectively be projected. An illumination lamp 505 is disposed below the fiche-carrier 502. Light from the lamp 505 is passed through a first condenser lens 507 and a second stationary condenser lens 507 and then turned by a stationary reflection mirror 509 through 90° toward a third fixed condenser lens 510. After passing through the third condenser lens 510, the light is incident on the film-side pupil of a projection lens 511 located above the fiche-carrier 502 to image the filament of the illumination lamp 505 thereon. The projection lens 511 may be replaced by one of the other projection lenses having different focal lengths in connection with a magnification to be selected. A spherical reflection mirror 506 is disposed behind the lamp 505 to collect the light from the lamp 505 for effectively utilizing it.

An image in the microfilm F contained in the fiche-carrier 502 is enlarged through the projection lens 511 and then reflected by first and second reflection mirrors 512 and 513 toward a projection screen 514 mounted on the casing 501 whereat the image can be observed. The first reflection mirror 512 is fixed to the upper face of the reader casing 501 while the second reflection mirror 513 is fixed to the side of the same. Behind the first reflection mirror 512, a photoelectronic converter element 515 is located on the optical axis and another photoelectronic converter element 516 is disposed adjacent the marginal portion of the mirror 512.

Figure 15:
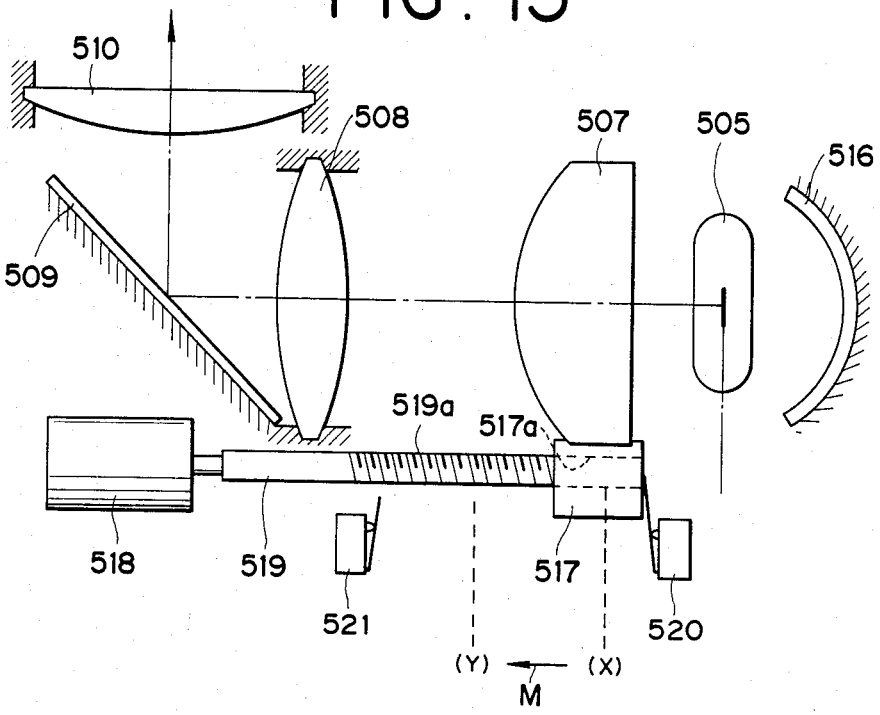
FIG. 15 is a schematic diagram of an illumination section used in the reader-printer shown in FIG. 14.

Referring to FIG. 15, the first condenser lens 507 is fixedly mounted on a lens fixing block 517 including a threaded aperture 517*a* formed therethrough. This threaded aperture 517*a* threadedly receives the threaded portion 519*a* on a screw rod 519 which is directly connected with a motor 518. As the motor 518 is energized, the lens fixing block 517 can move along the screw rod 519. The range in which the lens fixing block 517 moves is determined by limit switches 520 and 521.

Figure 16:
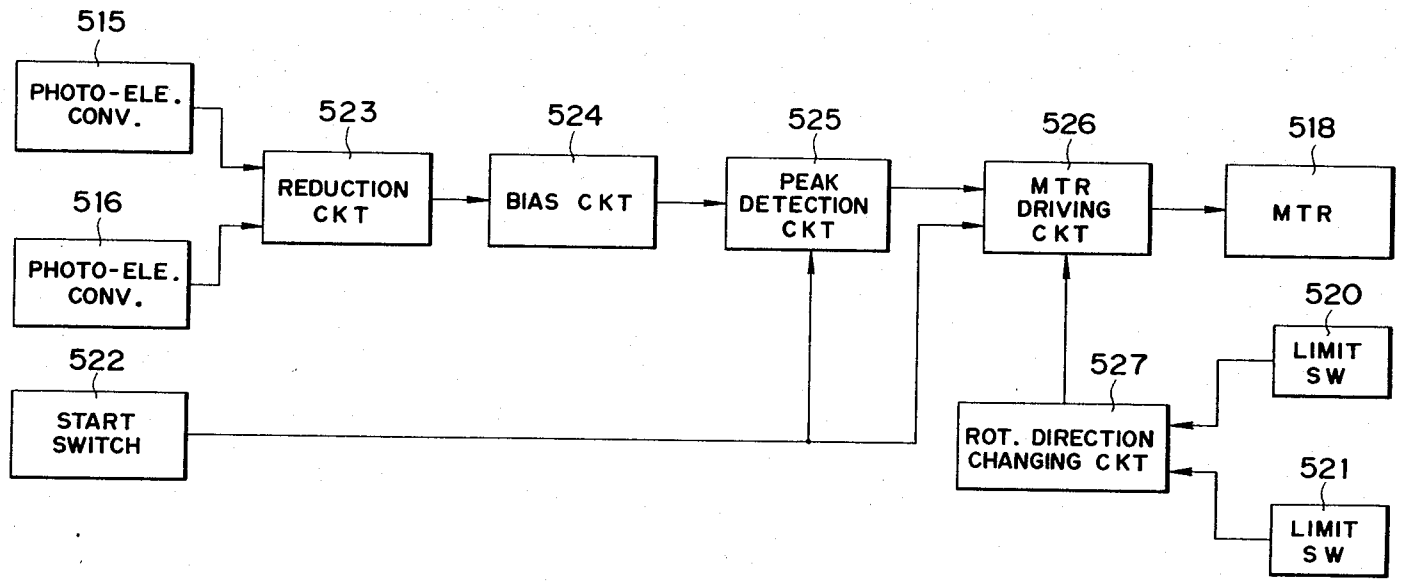
FIG. 16 is a block diagram of a control circuit used in the illumination section shown in FIG. 15.

FIG. 16 is a block diagram of a control circuit for the illumination section of the reader-printer shown in FIG. 15.

If the illumination lamp 505 is lighted through a power switch (not shown) with no microfilm F being inserted into the fiche-carrier 502 and when it is assumed that the first condenser lens 507 is in a position (X) (see FIG. 15), the photoelectronic converter elements 515 and 516 disposed behind the first reflection mirror 512 generate output voltages (A') and (B'), respectively. A reduction circuit 523 shown in FIG. 16 processes the output voltage of the photoelectronic converter element 516 minus the output voltage of the photoelectronic converter element 515 (B'−A'). A bias circuit 524 (FIG. 16) provides a negative output voltage by a constant bias applied thereto. This negative output voltage is converted into a positive output voltage which is supplied to a peak detection circuit 525 (FIG. 16). Unless the peak detection circuit 525 detects a peak signal, it remains inoperative with its output being zero.

If a start instruction switch 522 is turned on, a start signal is generated to actuate a motor drive circuit 526 (FIG. 16) to initiate the rotation of the motor 518. At the same time, the peak detection circuit 525 (FIG. 16) begins to operate. Thus, the first condenser lens 507 begins to move in a direction shown by an arrow M.

If the difference between the outputs of the central and peripheral photoelectronic converter elements reaches its minimum value, it is judged that the illumination position is properly selected. As the first condenser lens 507 reaches a position (Y), a peak is detected by the peak detection circuit 525. As a result, a stop signal is generated and supplied to the motor drive circuit 526 (FIG. 16) to deenergize the motor 518. In this manner, the illumination system is properly positioned. Subsequently, a microfilm F is inserted into the fiche-carrier 502 so that it can be observed under optimum conditions.

Although the peak value can be detected immediately after the motor has been energized in the above-mentioned embodiment, the lens fixing block 517 may be brought into engagement with the limit switch 520 or 521 if the first condenser lens 507 is not properly positioned and then moved in an inproper direction. At this time, a signal is applied to the rotational direction changing circuit 527 (FIG. 16) to generate a signal used to change the rotational direction of the motor. This signal is supplied to the motor drive circuit 526 to reverse the rotation of the motor 518. During this operation, the peak detection is continued. As a peak is detected, the motor 518 is stopped.

Although the above-mentioned embodiment has been described as to first rotate the motor in one direction and then reverse the rotation of the motor if no peak value is detected, the output of the reduction circuit or bias circuit may be utilized to process the present value and the preceding value to determine the rotational direction of the motor so that a peak value can always be obtained at the minimum distance.

The present invention can be applied to film readers, reader-printers and copying machines using originals in documents, books and others and further to either of the slit-exposure type or whole and coincidental exposure type copying system.

Figure 17:
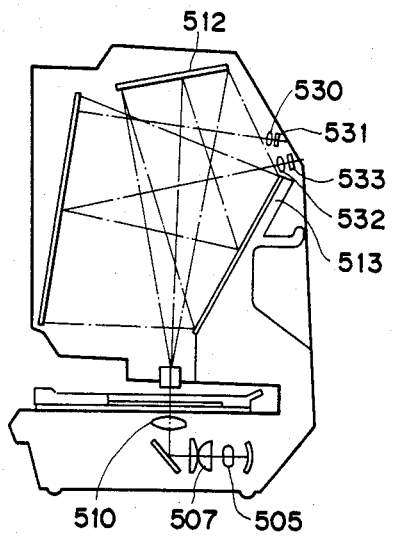
FIG. 17 is a schematic diagram of the reader-printer including the other embodiment of means for measuring the amount of light.

FIG. 17 shows a further embodiment of the present invention in which in place of the photoelectronic converter elements located behind the first reflection mirror 512 as shown in FIG. 14, lenses 530, 532 and photoelectronic converter elements 531, 533 are located between a first and second reflection mirrors 512 and 513. The amount of light on the center and periphery of a screen is measured by the combination of the lens system with the photoelectronic converter elements to detect a peak. The measurement of light may be effected in any area other than the above position.

Although the afore-mentioned embodiments have been described as to move the condenser lenses, a plurality of condenser lenses having different focal lengths may be mounted on a movable platform so that the desired one of the condenser lenses can be selected by moving the platform.

In the readers, copying machines and others in which it is required to change the magnification, the present invention can automatically provide an optimum state of illumination for each magnification on projection so that a clear and good image having no unevenness in illuminance can be observed or that a copy image having no unevenness in density can be obtained.

If the image projecting area on the projected plane is changed in magnitude on each change of magnification, the first and second photoelectronic converter elements may be displaced to detect the amount of light on the central and peripheral sections of the image projecting area.

What is claimed is:

1. A projection apparatus comprising:

a source of light for illuminating an original to be projected which is located at an illuminating position;

optical means for imaging the original illuminated by said source of light on a projection plane;

first measuring means for measuring, without the original at the illuminating position, the amount of light passing near the center of an optical path defined by said optical means;

second measuring means for measuring, without the original at the illuminating position, the amount of light passing near the marginal area of said optical path;

illuminance correcting means for changing a distribution of illuminance on said projection plane; and control means for controlling said illuminance correcting means in accordance with the measurements of said first and second measuring means to correct non-uniform distribution of illuminance.

2. A projection apparatus as defined in claim 1, wherein said illuminance correcting means includes a filter having its spectral transmission factor which changes from the center to the periphery of said filter, and means for moving said filter toward and away from said source of light.

3. A projection apparatus as defined in claim 1, wherein said illuminance correcting means includes a filter having a variable distribution of intensity for transmitted light, said filter being located optically between said source of light and said original.

4. A projection apparatus as defined in claim 1, wherein said illuminance correcting means includes a plurality of filters having different distributions of intensity for transmitted light, and means for moving said filters so that the selected one of them can be located optically between said source of light and said original.

5. A projection apparatus as defined in claim 1, wherein said illuminance correcting means includes means for moving said source of light toward and away from said original.

6. A projection apparatus as defined in claim 1, wherein said illuminance correcting means includes a condenser lens for condensing the light from said source of light and means for moving said condenser lens toward and away from said source of light.

7. A projection apparatus as defined in claim 1, wherein said illuminance correcting means includes a plurality of condenser lenses for condensing the light from said source of light and means for moving the selected one of said condenser lenses between said original and said source of light.

8. A projection apparatus as defined in claim 2, wherein said control means processes a difference between said first and second measuring means, the resulting value being used to control said moving means to equalize the distribution of illuminance on said projected plane.

9. A projection apparatus as defined in claim 4, wherein said control means processes a difference between said first and second measuring means, the resulting value being used to control said moving means to equalize the distribution of illuminance on said projected plane.

10. A projection apparatus as defined in claim 5, wherein said control means processes a difference between said first and second measuring means, the resulting value being used to control said moving means to equalize the distribution of illuminance on said projected plane.

11. A projection apparatus as defined in claim 6, wherein said control means processes a difference between said first and second measuring means, the resulting value being used to control said moving means to equalize the distribution of illuminance on said projected plane.

12. A projection apparatus as defined in claim 7, wherein said control means processes a difference between said first and second measuring means, the resulting value being used to control said moving means to equalize the distribution of illuminance on said projected plane.

13. A projection apparatus as defined in claim 1, wherein said optical means includes an imaging lens and wherein said first measuring means is adapted to detect the amount of the light passing near the optical axis of said imaging lens and said second measuring means is adapted to detect the amount of the light passing near the marginal portion of said imaging lens.

14. A projection apparatus as defined in claim 3, wherein said filter is made of such a material that its spectral transmission factor varies when a voltage is applied thereto.

15. A projection apparatus as defined in claim 14, wherein said material is a liquid crystal.

16. A projection apparatus as defined in claim 14, wherein said material is an electrochromic substance.

17. A projection apparatus as defined in claim 14, wherein said material is a photochromic substance.

18. A reader-printer comprising:

a source of light for illuminating an original located at a predetermined position;

optical means for projecting the image of said original illuminated by said source of light on a screen or photosensitive member;

first measuring means for measuring, without the original at the illuminating position, the amount of light passing near the center of an optical path defined by said optical means;

second measuring means for measuring, without the original at the illuminating position, the amount of light passing near the marginal portion of said optical path;

illuminance correcting means for changing the distribution of illuminance on the surface of said screen or photosensitive member; and control means for controlling said illuminance correcting means based on the measurements of said first and second measuring means to correct non-uniform distribution of illuminance on the screen or photosensitive member.

19. An image exposure apparatus comprising:

illumination means for illuminating an original located at a predetermined position;

optical means for imaging the original illuminated by said illuminating means on an imaging plane;

measuring means, disposed in an optical path formed between said predetermined position and said imaging plane, for measuring, when there is no original at the predetermined position, a distribution of light passing along the optical path;

illuminance correcting means for changing the distribution of illuminance on said imaging plane; and control means for controlling said illuminance correcting means in accordance with the measurement of said measuring means to correct non-uniform distribution of illuminance.

20. An image exposure apparatus as defined in claim 19, wherein said illuminance correcting means includes a filter disposed in the optical path of said illumination means and having a spectral transmission factor which changes from the center to the marginal portion of said filter, and means for moving said filter along the optical path of said illumination means.

21. An image exposure apparatus as defined in claim 19, wherein said illuminance correcting means includes a filter having a variable distribution of intensity for transmitted light.

22. An image exposure apparatus as defined in claim 21, wherein said filter is made of such a material that its spectral transmission factor changes when a voltage is applied thereto.

23. An image exposure apparatus as defined in claim 22, wherein said material is a liquid crystal.

24. An image exposure apparatus as defined in claim 22, wherein said material is an electrochromic substance.

25. An image exposure apparatus as defined in claim 22, wherein said material is a photochromic substance.

26. An image exposure apparatus as defined in claim 19, wherein said illuminance correcting means includes a plurality of filters having different distributions of intensity for transmitted light and means for moving the selected one of said filters into the optical path of said illumination means.

27. An image exposure apparatus as defined in claim 19, wherein said illuminance correcting means includes drive means for moving said illumination means along said optical illumination path.

28. An image exposure apparatus as defined in claim 27, wherein said illumination means includes a source of light and a condenser lens for condensing the light from said source of light and wherein said drive means is adapted to move said source of light or said condenser lens along said optical illumination path.

29. An image exposure apparatus as defined in claim 19, wherein said illumination means includes a source of light and a plurality of condenser lenses having different focal lengths and wherein said illuminance correcting means includes means for moving the selected one of said condenser lenses into the optical illumination path.

30. An image exposure apparatus as defined in claim 22, wherein said control means is adapted to process a difference between the measurements of said first and second measuring means, the resulting value being used to control said moving means to equalize the distribution of illuminance on the imaging plane.

31. An image exposure apparatus as defined in claim 23, wherein said control means is adapted to process a difference between the measurements of said first and second measuring means, the resulting value being used to control said moving means to equalize the distribution of illuminance on the imaging plane.

32. An image exposure apparatus as defined in claim 24, wherein said control means is adapted to process a difference between the measurements of said first and second measuring means, the resulting value being used to control said moving means to equalize the distribution of illuminance on the imaging plane.

33. An image exposure apparatus as defined in claim 25, wherein said control means is adapted to process a difference between the measurements of said first and second measuring means, the resulting value being used to control said moving means to equalize the distribution of illuminance on the imaging plane.

34. An image exposure apparatus as defined in claim 19, wherein said optical means includes an imaging lens for imaging said original on said imaging plane and wherein said first measuring means is adapted to measure the amount of the light passing near the optical axis of said imaging lens and said second measuring means is adapted to measure the amount of the light passing near the marginal portion of said imaging lens.

35. An image exposure apparatus as defined in claim 19, wherein said illuminance correcting means includes a filter disposed in the optical path of said illumination means and having a spectral transmission factor which changes from the center to the marginal portion of said filter, first drive means for moving said filter along the optical path of said illumination means, and second drive means for moving said illumination means along said optical path.

36. An image exposure apparatus as defined in claim 19, wherein said illuminance correcting means includes a filter having a variable distribution of intensity for transmitted light and means for moving said illumination means along said optical illumination path.

37. An image exposure apparatus as defined in claim 19, wherein said illuminance correcting means includes a plurality of filters having different distributions of intensity for transmitted light, first drive means for moving the selected one of said filters into the optical path of said illumination means, and second drive means for moving said illumination means along the optical path of said illumination means.

38. An image exposure apparatus as defined in claim 19, wherein said illumination means includes a source of light and a plurality of condenser lenses having different focal lengths and wherein said illuminance correcting means includes first drive means for moving said source of light along the optical path of said illumination means and second drive means for moving the selected one of said condenser lenses into the optical path of said illumination means.

* * * * *